US010614990B2

(12) United States Patent
Haig

(10) Patent No.: US 10,614,990 B2
(45) Date of Patent: Apr. 7, 2020

(54) TARGET ASSEMBLY FOR AN X-RAY EMISSION APPARATUS AND X-RAY EMISSION APPARATUS

(71) Applicant: NIKON METROLOGY NV, Leuven (BE)

(72) Inventor: Ian George Haig, Uxbridge MiddleSex (GB)

(73) Assignee: NIKON METROLOGY NV, Leuven (BE)

( * ) Notice: Subject to any disclaimer, the term of this patent is extended or adjusted under 35 U.S.C. 154(b) by 213 days.

(21) Appl. No.: 15/776,716

(22) PCT Filed: Dec. 21, 2016

(86) PCT No.: PCT/EP2016/082133

§ 371 (c)(1),
(2) Date: May 16, 2018

(87) PCT Pub. No.: WO2017/108923

PCT Pub. Date: Jun. 29, 2017

(65) Prior Publication Data

US 2018/0301312 A1 Oct. 18, 2018

(30) Foreign Application Priority Data

Dec. 23, 2015 (GB) ..... 1522885.1

(51) Int. Cl.
*H01J 21/00* (2006.01)
*H01J 35/06* (2006.01)
(Continued)

(52) U.S. Cl.
CPC ..... *H01J 35/065* (2013.01); *H01J 35/08* (2013.01); *H01J 35/16* (2013.01);
(Continued)

(58) Field of Classification Search
CPC ... A61B 6/40; H01J 17/00; H01J 17/02; H01J 17/06; H01J 19/00; H01J 19/02;
(Continued)

(56) References Cited

U.S. PATENT DOCUMENTS 6,125,169 A 9/2000 Wandke et al.
6,775,354 B1 8/2004 Roffers
(Continued)

FOREIGN PATENT DOCUMENTS

CN 101101848 1/2008
DE 102009017924 A1 11/2010
(Continued)

OTHER PUBLICATIONS

Chinese Office Action in related CN Application No. 201680073027.0 dated Jul. 1, 2019, 8 pages.
(Continued)

*Primary Examiner* — David P Porta
*Assistant Examiner* — Mamadou Faye
(74) *Attorney, Agent, or Firm* — Andrew M. Calderon; Roberts Calderon Safran & Cole, P.C.

(57) ABSTRACT

A target assembly for an x-ray emission apparatus, the apparatus assembly including: a vacuum chamber having at least one conductive wall; an insulating element projecting through the conductive wall; a conductive high voltage element extending along the insulating element from outside the chamber to an end portion of the insulating element furthest from the conductive wall; an x-ray-generating target arranged at the end portion of the insulating element and electrically connected to the high voltage element; and a suppressive electrode arranged at the end portion of the insulating element and configured to suppress acceleration toward the outer surface of the insulating element of electrons which are emitted from a junction between the outer surface of the insulating element and an inner surface of the conductive wall.

21 Claims, 3 Drawing Sheets

(51) Int. Cl.
*H01J 35/16* (2006.01)
*H01J 35/08* (2006.01)

(52) U.S. Cl.
CPC . *H01J 2235/0233* (2013.01); *H01J 2235/088* (2013.01); *H01J 2235/168* (2013.01)

(58) Field of Classification Search
CPC .. H01J 35/00; H01J 35/02; H01J 35/04; H01J 35/065; H01J 35/08; H01J 35/16; H01J 35/064; H01J 2235/00; H01J 2235/0233; H01J 2235/088; H01J 2235/168; H01G 1/00; H01G 1/02; H01G 1/52
See application file for complete search history.

(56) References Cited

U.S. PATENT DOCUMENTS

| | | | | |
|---|---|---|---|---|
| 8,213,575 | B2 | 7/2012 | Tamura et al. | |
| 2003/0002627 | A1* | 1/2003 | Espinosa ..... | B82Y 10/00 378/136 |

FOREIGN PATENT DOCUMENTS

| | | | |
|---|---|---|---|
| EP | 0634885 | | 1/1995 |
| GB | 2108754 | | 5/1983 |
| JP | 58080251 | | 5/1983 |
| JP | 2002218610 | | 8/2002 |
| JP | 2005259543 | | 9/2005 |
| JP | 2009245806 | | 10/2009 |
| JP | 2017054679 | | 3/2017 |
| WO | 9848899 | A2 | 11/1998 |
| WO | 2008062519 | | 5/2008 |
| WO | 2009006592 | | 1/2009 |

OTHER PUBLICATIONS

International Search Report in related International Application No. PCT/EP2016/082133 dated Mar. 16, 2017, 4 pages.
Written Opinion of the International Searching Authority in related International Application No. PCT/EP2016/082133, 5 pages.
Japanese Office Action in related JP Application No. 2018-530498 dated Sep. 24, 2019, 3 pages.
International Search Report in related International Application No. GB1522885.1 dated Jun. 20, 2016, 2 pages.
Japanese Office Action in related JP Application No. 2018-530498 dated Apr. 15, 2019, 10 pages.

* cited by examiner

TARGET ASSEMBLY FOR AN X-RAY EMISSION APPARATUS AND X-RAY EMISSION APPARATUS

TECHNICAL FIELD

The present disclosure relates to x-ray emission apparatuses and particularly to target assemblies for such apparatuses. The present disclosure provides target assemblies which are able to achieve higher x-ray emission energies by elevating the electrical potential of the x-ray emission target relative to ground.

BACKGROUND

In x-ray imaging, metrology and spectroscopy systems, there is often a need to achieve emission of x-ray beams with relatively higher x-ray energy, that is, with shorter x-ray wavelength. Such beams can provide improved resolution-ray penetration, and hence improved contrast and resolution, especially when used in imaging apparatuses, and particularly in microfocus imaging apparatuses.

In x-ray emission apparatuses, x-ray emission is achieved by bringing a beam of accelerated electrons into interaction with a target of an x-ray generating material, usually a metal with a relatively high atomic number (Z) such as tungsten. The electrons are accelerated by emission from a source of relatively more negative electrical potential than the target, such that the electrons emitted from the source accelerate away from the source toward the target. Thermionic emission, for example, may be used to generate appropriate electrons for acceleration.

Electron beam generation and x-ray emission is usually performed under high vacuum conditions, because the presence of air in an electron beam apparatus can cause absorption of the electron beam and can prevent the maintenance of the high potential differences required to produce high-energy electrons, and thereby x-rays. However, even in an ultra-high vacuum system, there is a difficulty in achieving increasingly greater accelerating potentials, because increasing the potential of the source relative to the walls of the vacuum chamber in which it is enclosed increases the risk of vacuum breakdown and dissipation of the high potential difference, leading to failure. This can be mitigated to some degree by increasing the size of the vacuum chamber, but this renders the apparatus bulky, expensive and difficult to manufacture.

Accordingly, it has been proposed in a modified form of x-ray system to have a high negative potential difference between the electron source and the walls of the vacuum chamber and a high positive potential difference between the walls of the vacuum chamber and the x-ray target. In such a design, sometimes called a bipolar system, the electron beam is not only accelerated away from the electron source, but is accelerated toward the target. The total accelerating potential is the difference in potential between the source and the target, but the apparatus can be smaller as compared with a conventional apparatus because the potential difference between each of i) the source and the chamber and ii) the chamber and the target is much less than the total accelerating potential. Accordingly, the risk of vacuum breakdown is mitigated. Further, a magnetic focussing lens that is conventionally held at ground potential may be interposed in the beam tunnel between the negative cathode electrode and the positive target.

However, in realising such configurations, there has been a problem in stability of the positive part of the apparatus, namely that portion of the apparatus which contains the high-voltage target.

A candidate configuration for such a target assembly is shown in cross-section in FIG. 1. In FIG. 1, target assembly 90 has a vacuum chamber 91 which defines an enclosure for the target apparatus. Vacuum chamber 91 is adapted to maintain a sufficiently high vacuum, typically $10^{-5}$ mbar or better. Such vacuums may be achieved by ensuring that the enclosure is suitably vacuum-sealed, and then by applying a suitable vacuum pump, such as a turbo pump, to a pump port (not shown). High vacuum is necessary to support the electron beam.

The vacuum chamber 91 is held at ground potential, by a connection to ground (not shown).

At least one wall 92 is conductive, and advantageously the entire enclosure is conductive to avoid static accumulation. A suitable conductive material for forming the at least one conductive wall 92, and also the whole vacuum chamber 91, is aluminium.

A slightly tapered, rod-like insulating element 93 projects through conductive wall 92 of vacuum chamber 91. Insulating element 93 may be formed, for example of an insulating resin such as epoxy resin or polyetherimide (PEI) resin. Insulating element 93 contains a high voltage conductor 94 arranged coaxially with the insulating elements, which may be connected to a high voltage supply positioned outside chamber 91.

In the configuration shown in FIG. 1, insulating element 93 and conductor 94 each have a two-part construction, to enable easy coupling and decoupling of the chamber from the high voltage source. Insulating element 93 may, for example, be formed by a combination of a first tapered rod, having an internal tapered cavity formed within the first tapered rod, and a second tapered rod having external taper to match the internal taper of the first tapered rod so as to be accommodated within the first tapered rod. The conductor 94 may, for example, then be provided with a first part in the second tapered rod, and a second part within the first tapered rod. The first and second parts of the conductor may mate via a conductive coupler when the second tapered rod is accommodated in the cavity of the first tapered rod. However, such a configuration is not essential, and insulating element 93 and conductor 94 can each be of unitary construction.

Insulating element 93 supports, at an end portion 93*a* which is furthest from conductive wall 92, target housing 95. Target housing 95 is electrically connected to high voltage conductor 94. The high voltage carried on conductor 94 is exposed to the vacuum contained within chamber 91 at this point. Housing 95 supports x-ray generating target 96 and elevates x-ray generating target 96 to the high potential of conductor 94 by providing an electrical connection between conductor 94 and target 96.

In this configuration, housing 95 is made of a radiodense material, for example an 80% tungsten/20% copper alloy. Housing 95 has a cone-shaped opening to allow the generated x-rays, which have been generated by x-ray generating target 96, to emerge. This approach is able to limit the x-rays to a cone-shaped beam that is just large enough to illuminate a detector with which the apparatus is intended to operate at its intended position and orientation. Such an approach may reduce unwanted x-ray scatter, which may improve contrast. Such an approach may also reduce the thickness of any shielding need for parts of the apparatus that are not arranged along the direction of x-ray beam X.

The cone-shaped aperture may be closed by a thin transparent window, formed of, for example, a thin sheet of radiolucent material such as aluminium or beryllium to avoid gas, which has been generated by x-ray generating target 96 under irradiation by electron beam E, being ejected into the space between target housing 95 and an opposing wall of chamber 91, in which space a high electric field may be present. Such an approach may also therefore improve stability against gas-induced vacuum breakdown.

In this configuration, the target housing 95 is also provided with an entrance tunnel through which the electron beam E is able to reach the x-ray generating target 96. The entrance tunnel may have a deliberately reduced diameter. Such a configuration may provide a throttle to impede the gas which may be ejected from x-ray generating target 96 as described above.

Chamber 91 has an x-ray emission window 97 arranged adjacent to x-ray generating target 96 so that x-rays X generated from the target can exit the chamber while preserving the high vacuum in the chamber. Such a window may be made, for example of a thin sheet of a material which is radiolucent (or transparent to x-rays) such as aluminium or beryllium. Target 96 is made of a high-atomic number (high-Z) material such as tungsten, which is able to generate x-rays when irradiated with a suitably high-energy electron beam.

Chamber 91 also has an electron beam acceptance aperture 98 through which an electron beam E may be introduced so as to impinge on x-ray generation target 96. Electron beam acceptance aperture 98 may have a mounting arrangement, not shown, adapted to couple target assembly 90 to an electron-beam gun so as to form a unitary vacuum chamber in a so-called two-arm arrangement. Such a mounting arrangement may include, for example, high vacuum seals arranged between an exit port of the electron-beam generator and beam introduction aperture 98 of target assembly 90.

In operation, target assembly 90 of FIG. 1 accepts an electron beam through aperture 98, which impinges on target 96, thereby generating x-rays X which are emitted through window 97. Target 96 is maintained at an elevated voltage via the electrical connection, through target housing 95, with conductor 94, which is supported within vacuum chamber 91 by insulating element 93 which extends through conductive wall of the vacuum chamber 91. By such an arrangement, the incident electron beam through aperture 98 can be further accelerated by the high positive potential of target 96 derived from conductor 94. Higher-energy X-rays may thereby be produced.

However, the configuration shown in FIG. 1 may exhibit a disadvantage in that, when the conductor 94 carries a high positive potential, a high potential gradient exists between conductor 94 and the surrounding chamber 91, especially conductive wall 92. Although insulating element 93 prevents the vacuum enclosed within vacuum chamber 91 from contacting conductor 94, and hence isolates conductor 94 from the vacuum, electrons are emitted from the most negative surface in the chamber, which electrons can multiply or avalanche as they interact with the surface of the insulating element that separates the most positive electrode, namely conductor 94, from the rest of the chamber. These processes can lead to an ionised path being created that allows a high voltage breakdown, with a convergent rapid discharge of the energy stored within the high-voltage-generating elements of the target assembly. In the configuration of FIG. 1, the conductive wall 92 of the housing, at least, acts as a strongly negative electrode creating a very large area that can provide a copious source of electrons.

Especially, at the interface T between i) the insulating element 93, ii) the metal wall 92 of the vacuum chamber, and iii) the vacuum, the potential barrier is lower and electrons easily escape from the metal into the vacuum. These electrons are accelerated towards the insulating element surface where they accumulate, causing the insulating element surface to become locally negatively charged, but also causing the release of multiple secondary electrons, especially if the incident electrons have energy significantly above 100 eV. These secondary electrons are also accelerated and cause further charging of the insulating element, as they "hop" progressively along the length of insulating element 93 towards target housing 95. This process leads to surface degassing of insulating element 93. The local gas cloud so produced may eventually become ionised by the avalanche electrons, creating a gas plasma channel through which the stored electrical energy and the high voltage system may suddenly and violently be discharged.

Such a discharge inhibits the maintenance of a stable high voltage source, and may be highly damaging to the apparatus.

Accordingly, there is a requirement for an improved target assembly which is able to inhibit such processes and which is able to maintain a high, stable, positive potential between the target and the enclosing vacuum chamber.

SUMMARY

According to a first aspect of the invention, there is provided a target assembly for an x-ray emission apparatus. The apparatus may comprise a vacuum chamber. The vacuum chamber may have at least one conductive wall. The apparatus may comprise an insulating element. The insulating element may project through the conductive wall. The apparatus may comprise a high voltage element. The high voltage element may extend along the insulating element. The high voltage element may extend from outside the chamber. The high voltage element may extend to an end portion of the insulating element furthest from the conductive wall. The apparatus may comprise an x-ray-generating target. The x-ray-generating target may be arranged at the end portion of the insulating element. The x-ray generating target may be electrically connected to the high voltage element. The apparatus may comprise a suppressive electrode. The suppressive electrode may be arranged at the end portion of the insulating element. This suppressive electrode may be configured to suppress acceleration towards the outer surface of the insulating element of electrons which are emitted from a junction between the outer surface of the insulating element and an inner surface of the conductive wall.

In one configuration, the suppressive electrode may be electrically connected to the high voltage element.

In one configuration, the suppressive electrode may extend from the end portion of the insulating element toward the conductive wall.

In one configuration, the suppressive electrode may surround at least part of the length of the insulating element.

In one configuration, the suppressive electrode may have a tapered portion which is tapered outwardly from the end portion of the insulating element.

In one configuration, the suppressive electrode may have a parallel portion nearest the conductive wall which is parallel to the outer surface of the electrode.

In one configuration, the suppressive electrode may be formed of a sheet.

In one configuration, the suppressive electrode may be formed of metal.

In one configuration, the high voltage element may be a conductor.

In one configuration, the suppressive electrode may have a thickened region at an end portion nearest the conductive wall.

In one configuration, an edge of the suppressive electrode which faces the conductive wall may be rounded.

In one configuration, the x-ray-generating target may be supported in a target housing.

In one configuration, the suppressive electrode may extend from the target housing.

In one configuration, the vacuum chamber may have an aperture for accepting an electron beam.

In one configuration, the vacuum chamber may have an aperture for passing x-rays generated from the x-ray-generating target.

In one configuration, the conductive wall may have a flat inner surface.

In one configuration, the high voltage element may be arranged to provide a potential of at least +100 kV relative to the conductive wall.

In one configuration, the high voltage element may be arranged to provide a potential of at least +150 kV relative to the conductive wall.

In one configuration, the high voltage element may be arranged to provide a potential of at least +200 kV relative to the conductive wall.

In one configuration, the conductive wall may be arranged to be earthed.

According to a second aspect of the present invention, there is provided an x-ray emission apparatus. The x-ray emission apparatus may comprise the target assembly of the first aspect. The apparatus may comprise an electron beam apparatus. The electron beam apparatus may be arranged to accelerate a beam of electrons towards an x-ray generating target. The x-ray emission apparatus may thereby generate x-ray radiation.

BRIEF DESCRIPTION OF THE DRAWINGS

For a better understanding of the present invention, and to show how the same may be carried into effect, reference will be made, by way of example only, to the accompanying drawings, in which.

DETAILED DESCRIPTION

Figure 1:
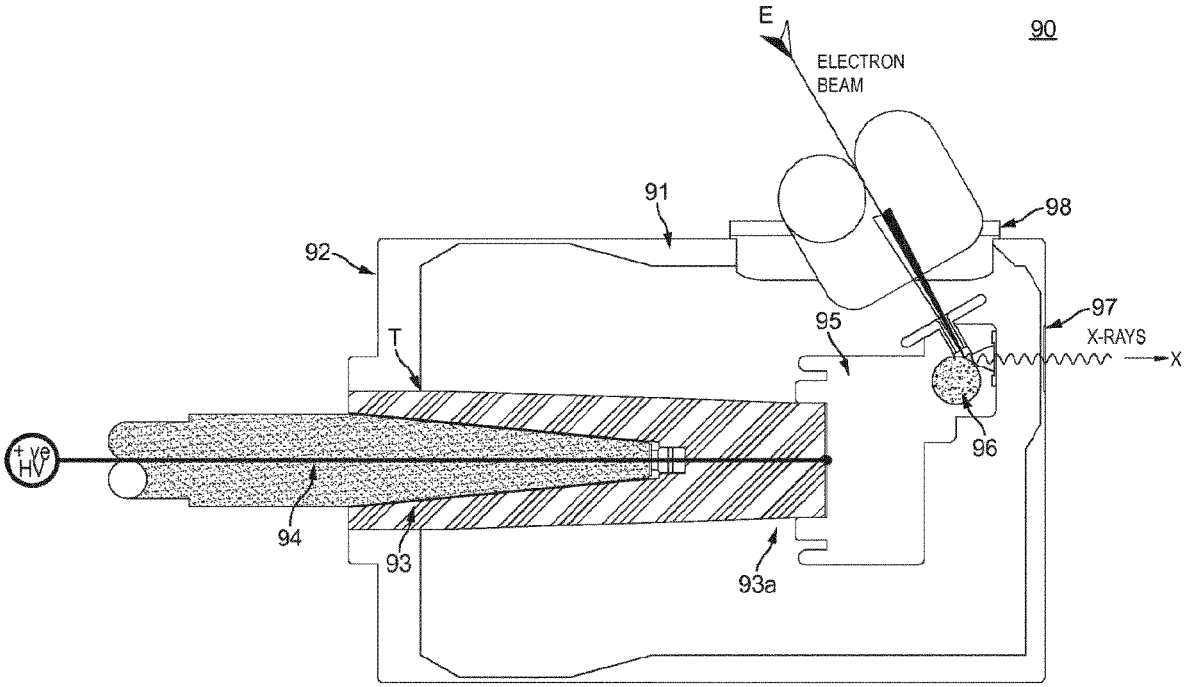
FIG. 1 shows an example of an x-ray-emission target assembly in cross-section which is relatively more susceptible to HV (high voltage) breakdown.
Figure 2:
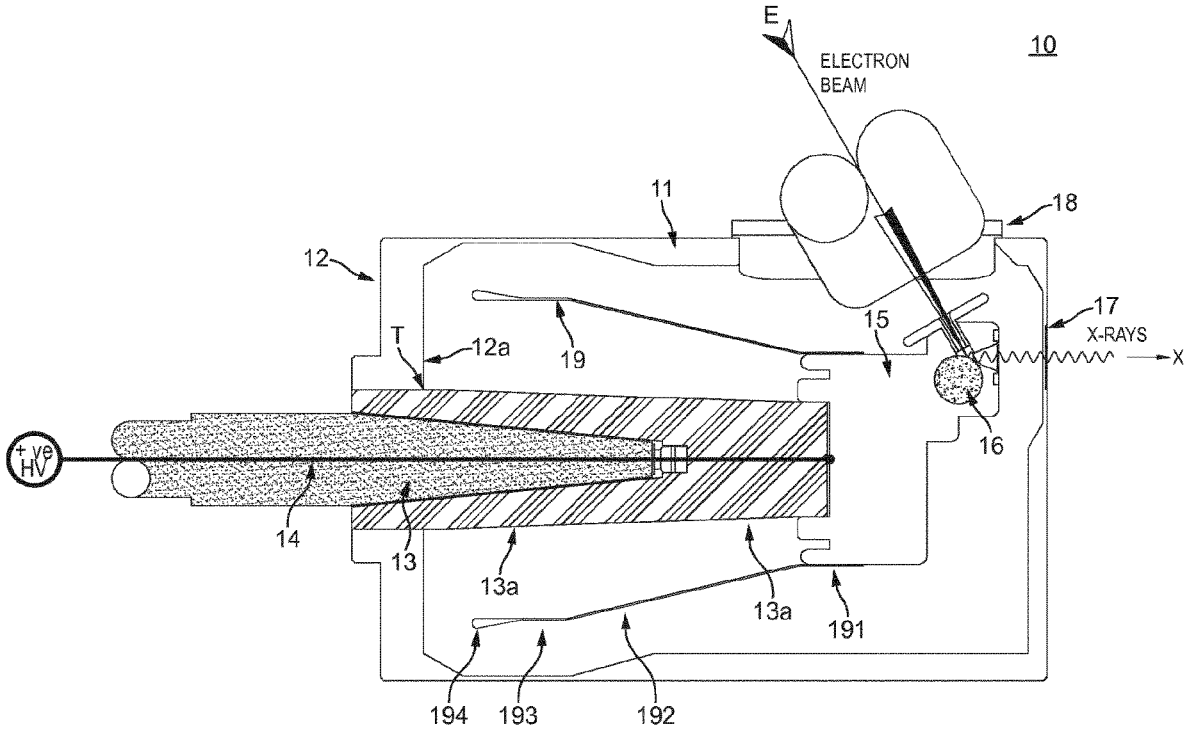
FIG. 2 shows an embodiment of an x-ray-emission target assembly in cross-section which is relatively less susceptible to HV breakdown.

One embodiment of the present disclosure is shown in FIG. 2 in cross-section. FIG. 2 shows a target assembly for an x-ray emission apparatus of similar construction to the configuration shown in FIG. 1. Elements having reference numerals of the form 9*x* in FIG. 1 are given reference numerals of the form 1*x* in FIG. 2 and may be assumed to be of substantially identical construction. For an understanding of the construction and operation of these aspects of the embodiment of FIG. 2, reference is made to the disclosure with regard to FIG. 1 above.

Unlike the configuration shown in FIG. 1, the embodiment shown in FIG. 2 is further provided with a suppressive electrode 19. The suppressive electrode 19 is arranged at the end portion 13*a* of insulating element 13 and extends toward conductive wall 12. The suppressive electrode may be referred to as a "flowerpot" by those skilled in the art, due to its resemblance in shape to the common garden container as shown in FIG. 2. However, such a designation is considered to be non-limiting as, as explained below, variation in the shape and geometry of suppressive electrode 19 is possible which retaining at least some of the advantages of the same.

In the present embodiment, therefore, suppressive electrode 19 is formed of four principal sections. A first section is approximately cylindrical, and surrounds target assembly 15, thereby to provide a good structural and electrical connection thereto. This portion is indicated as cylindrical support portion 191 in FIG. 2.

Extending away from cylindrical support portion 191 toward conductive wall 12 is conical tapered portion 192. Tapered portion 192 is tapered or flared outwardly as it extends away from housing 15 toward conductive wall 12. Therefore, the suppressive electrode 19 is progressively spaced further from the outer surface of insulating element 13 as suppressive electrode 19 approaches conductive wall 12.

Extending from tapered portion 192 is cylindrical parallel portion 193.

Extending from parallel portion 193 towards wall 12 is thickened region 194, which is thickened and rounded at the edge at which suppressive electrode 19 approaches conductive wall 12. Thickened region 194 can be formed, for example, as a thickened solid region by thickening and/or rounding the material from which suppressive electrode 19 is made, or alternatively, for example, by folding the material, from which suppressive electrode 19 is made, back on itself to form a rounded end.

The configuration of suppressive electrode 19 shown in FIG. 2 has been found to be especially effective in suppressing the acceleration, toward the outer surface of insulating element 13, of electrons which are emitted from the triple junction T between the outer surface of the insulating element 13, the inner surface 12*a* of conductive wall 12, and the vacuum enclosed by vacuum chamber 11.

However, variation in the geometry, shape and construction of suppressive electrode 19 is possible, as those skilled in the art will appreciate.

In the configuration of FIG. 2, the suppressive electrode 19 is electrically connected to the high voltage conductor 14. This provides particularly effective suppression of the acceleration of electrons from the triple junction T. However, it is possible for the electrode to be at a different potential, as required, for example due to the presence of a resistive element between high voltage conductor 14 and suppressive electrode 19, which may act as a voltage divider.

In FIG. 2, the suppressive electrode 19 extends from the end portion of the insulating element 13 toward the conductive wall. A gap exists between the thickened edge region 194 of suppressive electrode 19 and conductive wall 12. In other configurations, this gap may be increased or decreased as required.

In the configuration of FIG. 2, the suppressive electrode 19 surrounds part, but not all, of the length of insulating element 13, such that a gap exists between thickened region 194 and conductive wall 12. However, the proportion of the length of the insulating element, as well as the absolute size of the gap between the conductive wall 12 and the thickened region 194, may be varied in accordance with the overall design of the apparatus.

In the configuration of FIG. 2, tapered portion 192 is provided which tapers outwardly from the end portion 13*a* of insulating element 13. A taper angle of tapered portion 192 is around 12 degrees in the present embodiment, although variation of the taper angle may be adopted by for example ±10 degrees, without limitation. In some situations, a tapered portion may not be provided, and the suppressive electrode may, for example, be of cylindrical form. In other configurations, the tapered portion may be tapered inwardly.

In the configuration of FIG. 2, the suppressive electrode has a parallel portion 193 extending from tapered portion 192 towards conductive wall 12. In variant embodiments, this portion may be extended, or may be absent. Where present, it need not be strictly parallel, but may for example also be tapered inwardly or tapered outwardly.

In the configuration shown in FIG. 2, the suppressive electrode 19 is formed from a sheet of metal, specifically aluminium. For example, suppressive electrode 19 may be formed from machined or spun aluminium. Other conductive materials, such as copper foil, could also be contemplated. Such a configuration provides good structural properties as well as good electrical conductivity. However, in other configurations, the electrode may be formed of a sheet of metal mesh, for example, which may reduce material usage and weight, and may be easier to form.

In the configuration shown in FIG. 2, suppressive electrode 19 has a thickened region 194 nearest to conductive wall 12. Such a thickened region may avoid concentrating the electric field and thus may reduce the possibility of vacuum breakdown between the electrode 19 and wall 12. However, in other configurations, this thickened portion may be absent. In the configuration of FIG. 2, the thickened portion has a rounded end, although again this rounded end may be absent as it may not be required in certain configurations of vacuum chamber.

In the configuration of FIG. 2, the x-ray-generating target 16 is arranged in a target housing 15, and is offset relative to the central axis 14 defined by conductor 14. However, this configuration is exemplary, and the location of target 16 may differ. The position of target 16 shown in FIG. 2 is in some cases advantageous for easy accessibility of target 16 to the incident electron beam entering through aperture 18.

In the configuration shown in FIG. 2, the suppressive electrode 19 extends from target housing 15. However, suppressive electrode 19 may in certain circumstances extend directly from insulating element 13, or may be provided on a separate support structure around insulating element 13 other than target housing 15.

In the configuration of FIG. 2, the suppressive electrode 19 is symmetric about the axis of conductor 14. However, such symmetry may not be required, and suppressive electrode may, for example, exhibit an oval, rather than rounded, cross-section looking along the axis of conductor 14, or may exhibit another cross section looking in this direction, for example to take account of possible variations in the geometry of chamber 11.

In the configuration shown in FIG. 2, the vacuum chamber 11 has an aperture 18 for accepting an electron beam into the vacuum chamber to impinge upon target 16 in a so-called two-arm arrangement. However, in other configurations, the vacuum chamber may also enclose an electron beam emission source, together with one or more appropriate electron-optical lenses (including, for example, magnetic lenses and electrostatic lenses), beam shapers and the like so as to form a complete system within one chamber 11. Accordingly, the configuration of FIG. 2 is modular and can be retrofitted to an existing electron beam generation apparatus, but the principles can equivalently be applied to a non-modular system wherein all elements are contained within the one unitary vacuum enclosure.

In the configuration shown in FIG. 2, the vacuum chamber has an x-ray emission window 17 for passing x-rays to a sample or other object under investigation. The presence of a solid window across aperture 17 allows the sample to be external to the chamber 11, such that the sample may be held in an atmosphere, rather than in a vacuum. However, in other configurations, it is acceptable to arrange the entire x-ray system, including a sample mount and a detector for the x-ray radiation having passed through the sample, within a unitary vacuum chamber 11.

In the configuration shown in FIG. 2, the inner surface 12*a* of conductive wall 12 is flat, and extends perpendicular to outer surface 13*a* of insulating element 13. Such configuration is advantageous in avoiding high potential gradients within the vacuum chamber 11. However, other configurations are possible in which wall 12*a* is, for example, curved inwardly or outwardly.

In the configuration shown in FIG. 2, the high voltage conductor 14 is arranged to provide a positive potential of, for example, at least +100 kV relative to the conductive wall. However, with increasing voltage, the advantage of target potential elevation in terms of achieving higher electron beam energies is increased, but so too is the risk of vacuum breakdown and instability. Accordingly, the presence of suppressive electrode 19 becomes even more advantageous at more elevated potentials, such as +150 kV, +200 kV, or even higher, of the high voltage conductor 14 relative to conductive wall 12.

In the configuration shown in FIG. 2, the conductive wall 12 is arranged to be earthed, although in some circumstances it may be desirable to adjust the potential of the conductive wall 12 relative to earth to obtain a favourable balance between the potential on high voltage conductor 14 and the potential on conductive wall 12, as well as the potential of any components of the electron beam generation side of the electron beam apparatus, such as an electron-emitting cathode. In other embodiments, a favourable balance may be obtained by adjusting the share of the total accelerating voltage borne by target 16 relative to earth and that borne by an emitting cathode, for example.

In the configuration shown in FIG. 2, a high voltage conductor 14 provides the high positive potential to target 16. Accordingly, a high voltage must be provided to high voltage conductor 14 outside chamber 11, which is sustained long its full length. However, in an alternative configuration, an alternative high voltage element, such as a voltage multiplier, for example a Cockroft-Walton voltage multiplier, may be used to at least partially develop the high voltage progressively along the length of insulating element 13 on the basis of a lower drive voltage applied from outside the chamber. Even though such a situation may result in a reduced field at the triple junction T as compared with the situation of a high voltage conductor, the provision of a suppressive electrode as herein disclosed may be beneficial in suppressing any electron emission from the triple junction which may result.

The embodiment of FIG. 2 is shown accepting an electron beam through aperture 18. However, an embodiment of the apparatus includes an embodiment wherein an electron beam apparatus is coupled to electron acceptance aperture 18 to provide a complete x-ray emission apparatus.

Many variations are possible within the scope of the embodiment disclosed in connection with FIG. 2, without deviating from the essential principles of the invention herein disclosed. Such variants may be made using only routine workshop trial and error for the optimum configuration for any given geometry of vacuum chamber 11, insulating element 13 and conductor 14.

Now, an explanation will be made of at least one advantage which may be achieved with a suppressive electrode as herein disclosed and exemplified by the embodiment of FIG. 2, or variants thereof, with reference to the equipotential lines achieved in the absence of and presence of, respectively, suppressive electrode 192.

Figure 3A:
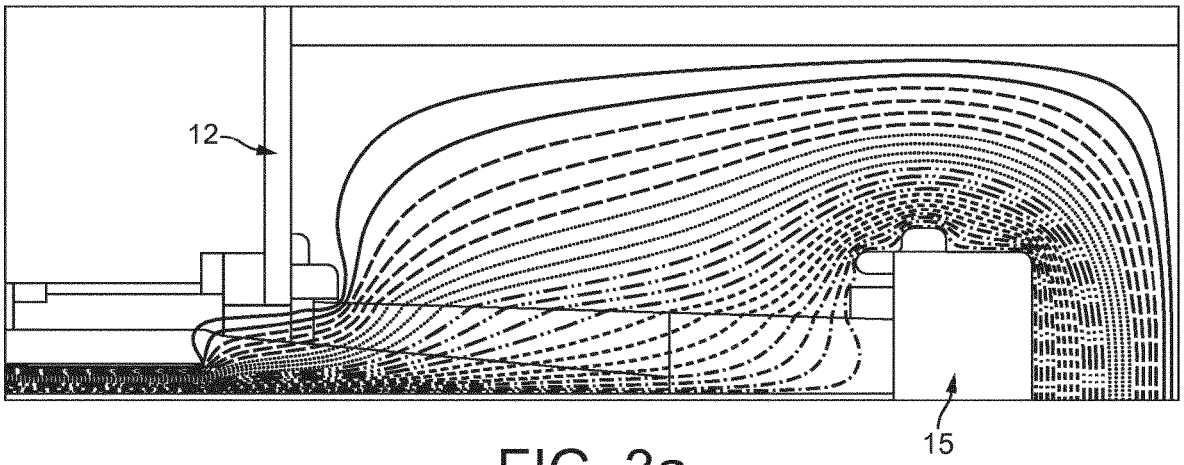
FIG. 3*a* is a equipotential diagram relating to the assembly of FIG. 1.

In FIG. 3*a*, the configuration of FIG. 2 is shown in cross-section, suppressive electrode 19 having been removed. The configuration is thus similar to FIG. 1. Equipotential lines arising from a +220 kV potential on high voltage conductor 14 are also shown, at 10 kV intervals.

As can be seen in FIG. 3*a*, along almost the entire length of insulating element 13, there is a very significant component of the electric field (which crosses the equipotential lines at right angles) into the outer surface of the insulating element 13. Accordingly, any electrons emitted from triple junction T, regardless of their angle of emission, will be captured by the positive potential and will be accelerated toward the surface of the insulating element, potentially giving rise to instability and discharge.

Figure 3B:
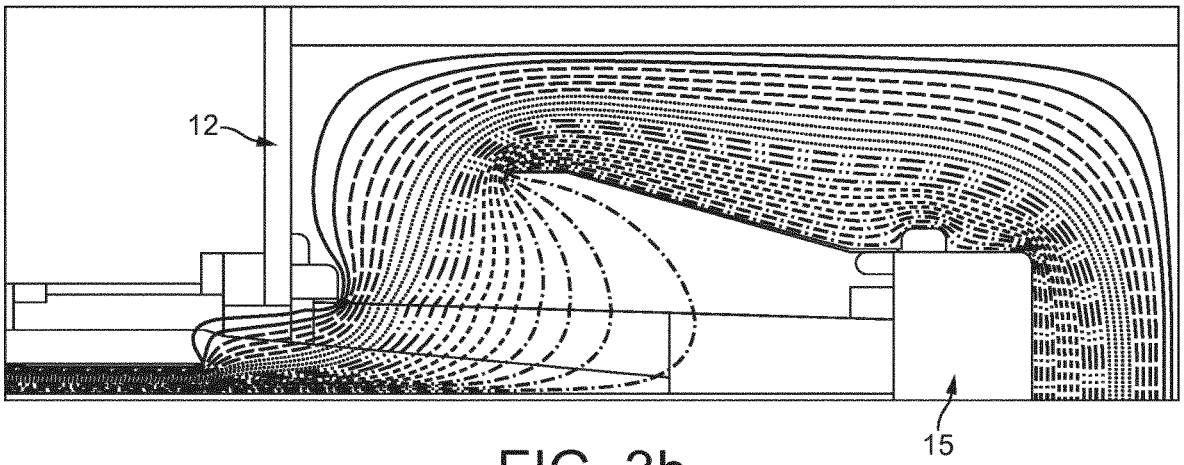
FIG. 3*b* is an equipotential diagram relating to the assembly of FIG. 2.

In contrast, when a suppressive electrode is used as shown in FIG. 3*b*, corresponding to the configuration of FIG. 2, the component of the electric field directed toward the insulating element 13, at least for the first part of the insulating element extending from wall 12, is much reduced. Therefore, the tendency is for electrons to be accelerated along, rather than into, insulating element 13.

Further, within the opening defined by thickened portion 194 of suppressive electrode 19, the electric field direction gradually changes from a slight inclination toward insulating element 13 to a significant inclination away from insulating element 13, toward suppressive electrode 19.

Thus, suppressive electrode 19 is not only able to divert the emitted electrons away from the surface of insulating element 13, but is also able to capture the diverted electrons.

Yet further, within the opening defined by thickened portion 194 of suppressive electrode 19, the equipotential lines become relatively greater in spacing one from another, indicating a reduction in electric field strength along the length of the surface of insulating element 13, at least, in this region.

Thus, suppressive electrode 19 is also able to reduce the accelerating field experienced by the emitted electrons in this region.

Again, it can be appreciated from FIG. 3*b* that variations in the shape and geometry of suppressive electrode 19 will allow the same effect to be maintained, and may in some circumstances be advantageous for accommodating different geometries of enclosure, target housing and other elements of the system. However, such variations can easily be adopted by the skilled person using basic electron optical principles, once the importance of suppressive electrode 19 as a concept is recognised.

Accordingly, the configuration in FIG. 2 and its variants hereby described and claimed provides at least a solution to the technical problem of avoiding high voltage breakdown in bipolar x-ray systems having a negative-potential emission source and a positive-potential target. Such configuration can thus achieve higher working electron voltages, and thus x-ray beam energies, leading to improved x-ray penetration, and hence improved contrast and resolution especially in microfocus x-ray imaging systems.

The invention claimed is:

1. A target assembly for an x-ray emission apparatus, the assembly comprising:

a vacuum chamber having at least one conductive wall;

an insulating element projecting through the conductive wall;

a conductive high voltage element extending along the insulating element from outside the chamber to an end portion of the insulating element furthest from the conductive wall;

an x-ray-generating target arranged at the end portion of the insulating element and electrically connected to the high voltage element; and a suppressive electrode arranged at the end portion of the insulating element and configured to suppress acceleration toward the outer surface of the insulating element of electrons which are emitted from a junction between the outer surface of the insulating element and an inner surface of the conductive wall.

2. The target assembly of claim 1, wherein the suppressive electrode is electrically connected to the high voltage element.

3. The target assembly of claim 1, wherein the suppressive electrode extends from the end portion of the insulating element towards the conductive wall.

4. The target assembly of claim 1, wherein the suppressive electrode surrounds at least a part of the length of the insulating element.

5. The target assembly of claim 1, wherein the suppressive electrode has a tapered portion which is tapered outwardly from the end portion of the insulating element.

6. The target assembly of claim 1, wherein the suppressive electrode has a parallel portion nearest the conductive wall which is substantially parallel to the outer surface of the electrode.

7. The target assembly of claim 1, wherein the suppressive electrode is formed of a sheet.

8. The target assembly of claim 1, wherein the suppressive electrode is formed of metal.

9. The target assembly of claim 1, wherein the high voltage element is a conductor.

10. The target assembly of claim 1, wherein the suppressive electrode has a thickened region at an end nearest the conductive wall.

11. The target assembly of claim 1, wherein an edge of the suppressive electrode which faces the conductive wall is rounded.

12. The target assembly of claim 1, wherein the x-ray-generating target is supported in a target housing.

13. The target assembly of claim 12, wherein the suppressive electrode extends from the target housing.

14. The target assembly of claim 1, wherein the vacuum chamber has an aperture for accepting an electron beam.

15. The target assembly of claim 12, wherein the vacuum chamber has an aperture for passing x-rays generated from the x-ray-generating target.

16. The target assembly of claim 1, wherein the conductive wall has a flat inner surface.

17. The target assembly of claim 1, wherein the high voltage element is arranged to provide a potential of at least +100 kV relative to the conductive wall.

18. The target assembly of claim 1, wherein the high voltage element is arranged to provide a potential of at least +150 kV relative to the conductive wall.

19. The target assembly of claim 1, wherein the high voltage element is arranged to provide a potential of at least +200 kV relative to the conductive wall.

20. The target assembly of claim 1, wherein the conductive wall is arranged to be earthed.

21. An x-ray emission apparatus comprising:

the target assembly claim 1, and an electron beam apparatus arranged to accelerate a beam of electrons toward the x-ray-generating target, thereby to generate x-ray radiation.

* * * * *